US010208749B2

(12) United States Patent
Lim et al.

(10) Patent No.: US 10,208,749 B2
(45) Date of Patent: Feb. 19, 2019

(54) SCROLL COMPRESSOR WITH A RING MEMBER AND GUIDE PIN

(71) Applicant: Hanon Systems, Daejeon (KR)

(72) Inventors: Jae Hoon Lim, Daejeon (KR); Kweon Soo Lim, Daejeon (KR); Soo Cheol Jeong, Daejeon (KR); Hong Min Kim, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 7 days.

(21) Appl. No.: 14/911,502

(22) PCT Filed: Jun. 19, 2015

(86) PCT No.: PCT/KR2015/006249
§ 371 (c)(1),
(2) Date: Feb. 11, 2016

(87) PCT Pub. No.: WO2016/143952
PCT Pub. Date: Sep. 15, 2016

(65) Prior Publication Data

US 2018/0163724 A1 Jun. 14, 2018

(30) Foreign Application Priority Data

Mar. 6, 2015 (KR) ..... 10-2015-0031824

(51) Int. Cl.
*F03C 2/00* (2006.01)
*F03C 4/00* (2006.01)
(Continued)

(52) U.S. Cl.
CPC ..... *F04C 18/0215* (2013.01); *F01C 17/06* (2013.01); *F04C 29/0057* (2013.01); *F04C 29/0078* (2013.01); *F04C 2240/30* (2013.01)

(58) Field of Classification Search
CPC ..... F04C 18/0215; F04C 29/0057; F04C 29/0078; F04C 2240/30
(Continued)

(56) References Cited

U.S. PATENT DOCUMENTS 8,353,692 B2 1/2013 Mori et al.
2010/0209278 A1* 8/2010 Tarao ..... F04C 18/0215 418/55.3
(Continued)

FOREIGN PATENT DOCUMENTS

DE 102014200123 A1 7/2014
DE 102014113435 A1 3/2016
(Continued)

*Primary Examiner* — Theresa Trieu
(74) *Attorney, Agent, or Firm* — Shumaker, Loop & Kendrick, LLP; James D. Miller

(57) ABSTRACT

The present invention relates a scroll compressor. According to an exemplary embodiment of the present invention, the scroll compressor includes: an orbiting scroll configured to be seated on one surface of a main frame and provided with a plurality of seating grooves along a circumferential direction; a stepped part configured to be formed in the seating groove; a ring member configured to be inserted into the seating groove and have a lower surface adhering to the stepped part; and a guide pin configured to have one end fixed to the main frame and the other end extended in an inside length of the ring member, in which the guide pin has the end maintained in a spaced state from the stepped part.

15 Claims, 9 Drawing Sheets

(51) Int. Cl.

| | |
|---|---|
| ***F04C 2/00*** | (2006.01) |
| ***F04C 18/00*** | (2006.01) |
| ***F04C 18/02*** | (2006.01) |
| ***F01C 17/06*** | (2006.01) |
| ***F04C 29/00*** | (2006.01) |

(58) Field of Classification Search
USPC ..... 418/55.1–55.6, 57; 464/102
See application file for complete search history.

(56) References Cited

U.S. PATENT DOCUMENTS

| | | | | |
|---|---|---|---|---|
| 2011/0243777 | A1* | 10/2011 | Ito ..... | F04C 18/0246 418/55.2 |
| 2012/0237381 | A1* | 9/2012 | Murakami ..... | F04C 18/0215 418/55.1 |
| 2014/0369819 | A1 | 12/2014 | Yamashita et al. | |

FOREIGN PATENT DOCUMENTS

| | | | |
|---|---|---|---|
| JP | H08338376 | A | 12/1996 |
| JP | 2012167605 | A | 9/2012 |
| KR | 20140095827 | A | 8/2014 |
| KR | 20150020795 | A | 2/2015 |
| KR | 1020150020795 | A | 2/2015 |
| WO | 2016067206 | A1 | 5/2016 |

* cited by examiner

SCROLL COMPRESSOR WITH A RING MEMBER AND GUIDE PIN

CROSS-REFERENCES TO RELATED APPLICATIONS

This patent application is a United States national phase patent application based on PCT/KR2015/006249 filed on Jun. 19, 2015, which claims the benefit of Korean Patent Application No. 10-2015-0031824 filed on Mar. 6, 2015. The disclosures of the above patent applications are hereby incorporated herein by reference in their entirety.

BACKGROUND OF THE INVENTION

Field of the Invention

Exemplary embodiments of the present invention provide a stable revolution depending on an operation of an orbiting scroll, and more particularly, to a scroll compressor capable of minimizing deformation and noise occurrence due to a stress concentration on a guide pin which occurs during a revolution and vertical movement based on a rotating shaft depending on an operation of an orbiting scroll.

Description of the Related Art

Generally, a scroll compressor is a compressor using a fixed scroll having a spiral wrap and an orbiting scroll orbiting with respect to the fixed scroll, and results in an apparatus for reducing volumes of compression chambers formed between the fixed scroll and the orbiting scroll depending on an orbiting motion of the orbiting scroll while the fixed scroll and the orbiting scroll are engaging with each other and increasing a pressure of fluid correspondingly to discharge a refrigerant through an outlet formed at a central portion of the fixed scroll.

The scroll compressor continuously performs intake, compression, and discharge while the orbiting scroll is orbited. As a result, the scroll compressor does not have to principally include a discharge valve and an intake valve and has the reduced number of parts, such that the scroll compressor may have the simple structure and may be rotated at a high speed. Further, the scroll compressor is rarely subjected to a change in torque required for the compression and continuously performs the intake and the compression, and as a result, may have reduced noise and vibration.

One of the important factors in the scroll compressor is leakage and lubrication problems between the fixed scroll and the orbiting scroll. To prevent the leakage between the fixed scroll and the orbiting scroll, an end of the wrap adheres to a surface of a mirror plate portion to prevent the compressed refrigerant from leaking. On the other hand, a resistance due to friction needs to be minimized to smoothly orbit the orbiting scroll with respect to the fixed scroll, but the leakage and lubrication problems have a conflict relationship with each other. That is, when the end of the wrap strongly adheres to the surface of the mirror plate portion, the leakage is reduced, but the friction is increased and thus damage due to noise and abrasion is increased. On the other hand, when the adhesion strength is reduced, the friction is reduced, but a sealing force is reduced and thus the leakage is increased.

Therefore, the related art forms a back pressure chamber having an intermediate pressure defined as a value between a discharge pressure and a suction pressure on a back surface of the orbiting scroll or the fixed scroll to solve a problem of the sealing and friction problem. That is, the back pressure chamber communicating with the compression chamber having the intermediate pressure among the plurality of compression chambers formed between the orbiting scroll and the fixed scroll is formed to appropriately adhere between the orbiting scroll and the fixed scroll, thereby solving the leakage and lubrication problems.

Meanwhile, the back pressure chamber may be positioned on a bottom surface of the orbiting scroll or an upper surface of the fixed scroll. Here, when the back pressure chamber is positioned on the bottom surface of the orbiting scroll, a shape and a position of the back pressure chamber are changed depending on the orbiting motion, and thus the vibration and the noise may be highly likely to occur while the orbiting scroll being tilted and an O-ring inserted to prevent the leakage may be worn quickly. Meanwhile, an upper back pressure type has a relatively more complicated structure but has a form and a position in which the back pressure chamber is fixed, and as a result, has an advantage that the fixed scroll may be less likely to be tilted and the sealing of the back pressure chamber may be good.

The scroll compressor having the features has a structure in which sleeve rings are seated in a plurality of seating grooves formed in a circumferential direction of the upper surface of the mirror plate portion of the orbiting scroll and a pin member is positioned to adhere to the sleeve ring to prevent the orbiting scroll from stably revolving and rotating.

When the pin member vertically moves during the revolution of the scroll compressor, noise occurs due to the collision of the pin member with the seating groove, and as a result, a specific position of the pin member is concentrated with a stress and thus the pin member may be damaged.

SUMMARY OF THE INVENTION

An object of the present invention relates to a scroll compressor capable of stably seating and rotating a ring member equipped in an orbiting scroll of the scroll compressor and stably operating guide pins disposed on an outer circumferential surface of the ring member.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with one aspect of the present invention, a scroll compressor includes: an orbiting scroll configured to be seated on one surface of a main frame and provided with a plurality of seating grooves along a circumferential direction; a stepped part configured to be formed in the seating groove; a ring member configured to be inserted into the seating groove and have a lower surface adhering to the stepped part; and a guide pin configured to have one end fixed to the main frame and the other end extended in an inside length of the ring member, in which the guide pin may have the end maintained in a spaced state from the stepped part.

The ring member may be inserted in a state in which it is maintained at a first gap d from an inner circumferential surface of the seating groove.

The stepped part may have a shape corresponding to the lower surface of the ring member.

An upper surface of the stepped part may adhere to the lower surface of the ring member.

The scroll compressor may further include: a fixed scroll configured to be disposed at an upper portion of the orbiting scroll, in which the ring member inserted into the seating groove may relatively move in a vertical direction of the seating groove on the basis of a change in pressure according to a compression and a discharge of a refrigerant depending on a relative rotation of the orbiting scroll to the fixed scroll.

A moving distance in the vertical direction of the ring member may be maintained at a distance relatively larger than the first gap d.

A stress applied to a first section b of the guide pin maintaining a contact with an upper side of the ring member may be applied in a state in which it is dispersed depending on a vertical moving displacement of the ring member.

The guide pin may maintain the contact in the length direction in an outer circumferential surface of the ring member.

The ring member may have a longitudinal length L1 extended from the upper surface of the stepped part to an upper surface of the seating groove.

The stepped part may protrude at a first protruding thickness T1 from a circumferential direction of a bottom surface of the seating groove toward a central direction and protrude at a first protruding height H1 upward from the bottom surface of the seating groove 110.

The first protruding thickness T1 may be equal to or smaller than a thickness t1 of the ring member.

The ring member may maintain a partial contact with the upper surface of the stepped part.

The stepped part may have an upper surface extended up to a central position of the lower surface of the ring member.

The ring member may be inserted in a state in which it is maintained at a first gap from an inner circumferential surface of the seating groove formed along a circumferential direction of the orbiting scroll, the first gap may range from 20 μm to 45 μm, and a moving distance in a vertical direction of the ring member may be maintained at a distance relatively longer than the first gap.

In accordance with another aspect of the present invention, a scroll compressor includes: an orbiting scroll configured to be seated on one surface of a main frame and provided with a plurality of seating grooves along a circumferential direction; a stepped part configured to be formed in the seating groove; a ring member configured to be inserted into the seating groove and have a lower surface partially contacting the stepped part; and a guide pin configured to have one end fixed to the main frame and the other end extended in an inside length of the ring member.

The ring member may include: protruding parts protruded to contact the stepped part in a circumferential direction; and groove parts formed toward an inside of the ring member while being adjacent to the protruding parts.

The protruding parts and the groove parts may be alternately repeated along a circumferential direction of the ring member.

The protruding parts may be disposed so that they face each other at the lower surface of the ring member.

The protruding part may protrude at a length corresponding to a thickness of the ring member.

The guide pin may be maintained at a second gap from an inner circumferential surface of the ring member and may be maintained in a state in which a lower end of the guide pin is spaced apart from an upper surface of the stepped part.

Effect of the Invention

According to the exemplary embodiments of the present invention, it is possible to stably revolve the orbiting scroll by coping with the tolerances occurring during the relative movement of the orbiting scroll of the scroll compressor with respect to the fixed scroll.

According to the exemplary embodiments of the present invention, the structure of the ring member may be changed so that the ring member stably and relatively moves in the seating groove to reduce the friction force depending on the relative rotation of the ring member and minimize the stress concentration on the guide pin, thereby preventing the deformation and the damage of the guide pin.

According to the exemplary embodiments of the present invention, even when the orbiting scroll revolves depending on the change in pressure of the back pressure chamber and relatively moves with respect to the fixed scroll, the noise occurrence and the deformation due to the collision of the end of the guide pin with the seating groove may be prevented to maintain the stable operation of the orbiting scroll, thereby stably operating the scroll compressor.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF SPECIFIC EMBODIMENTS

Figure 1:
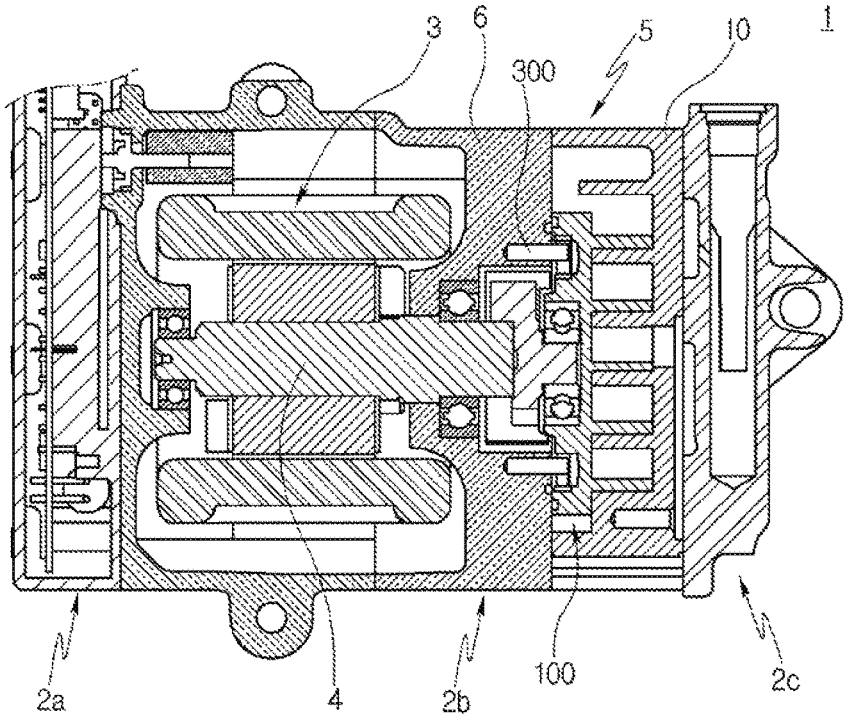
FIG. 1 is a longitudinal cross-sectional view of a scroll compressor according to a first exemplary embodiment of the present invention.
Figure 2:
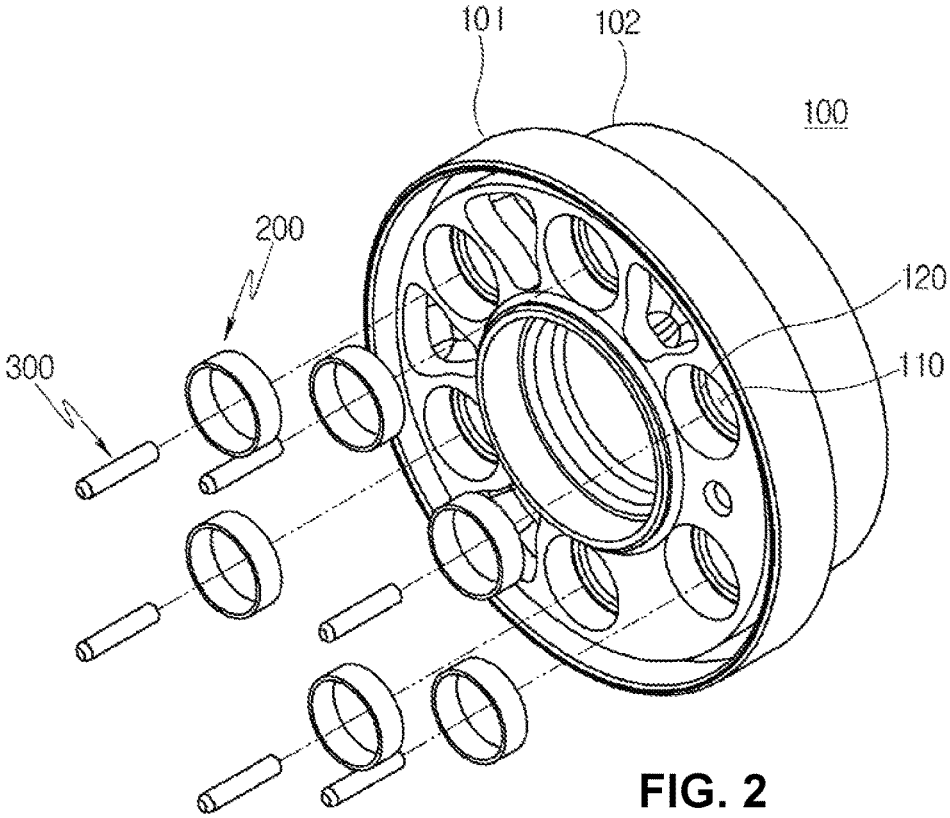
FIG. 2 is an exploded perspective view of an orbiting scroll according to a first exemplary embodiment of the present invention.
Figure 3:
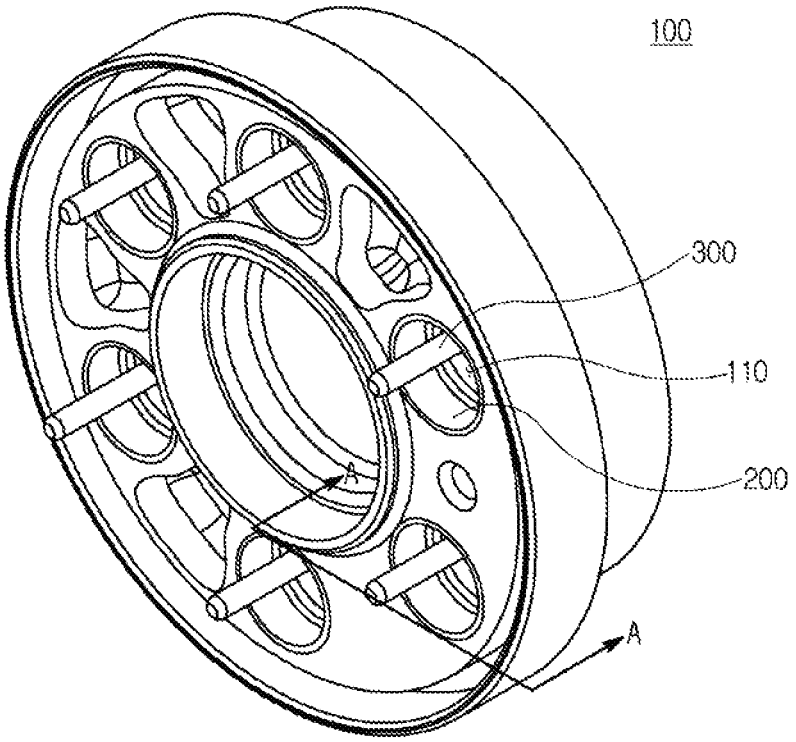
FIG. 3 is a coupled perspective view of FIG. 2.
Figure 4:
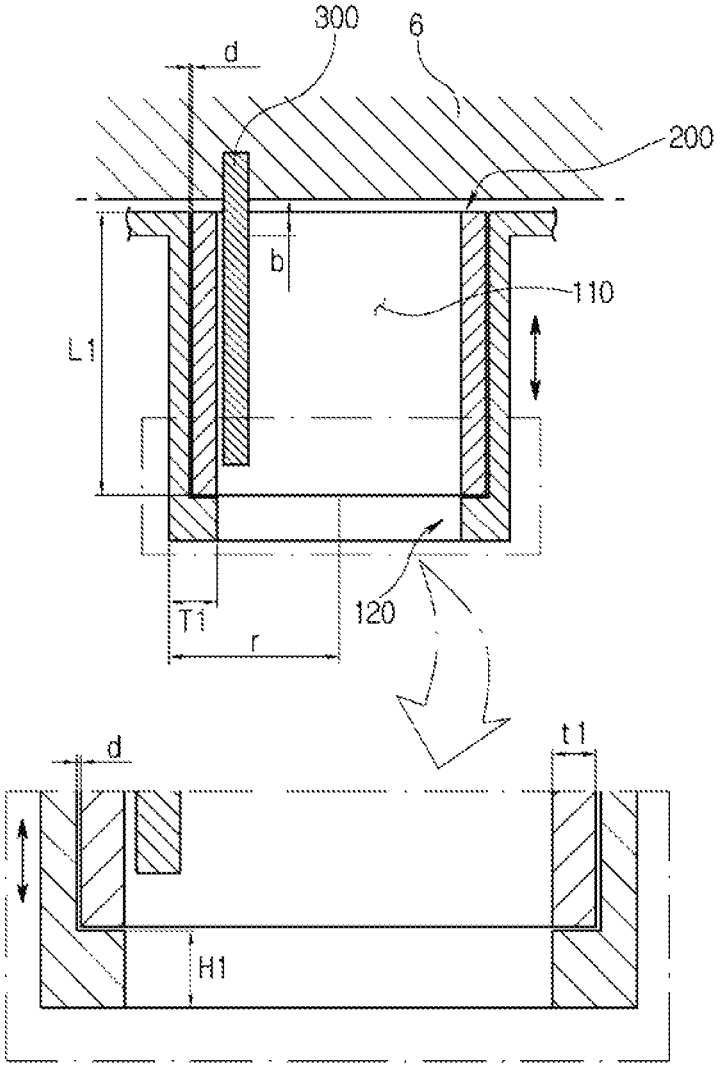
FIG. 4 is a partial cross-sectional view taken along the line A-A of FIG. 3.

A scroll compressor according to a first exemplary embodiment of the present invention will be described with the accompanying drawings. For reference, FIG. 1 is a longitudinal cross-sectional view of a scroll compressor according to a first exemplary embodiment of the present invention, FIG. 2 is an exploded perspective view of an orbiting scroll according to a first exemplary embodiment of the present invention, FIG. 3 is a coupled perspective view of FIG. 2, and FIG. 4 is a partial cross-sectional view taken along the line A-A of FIG. 3.

Referring to FIGS. 1 to 4, a scroll compressor 1 according to a first exemplary embodiment of the present invention may be configured to include a front housing 2*a* forming an appearance and formed at a position of an inlet into which a refrigerant is sucked, an intermediate housing 2*b*, and a rear housing 2*c*, in which the intermediate housing 2*b* has a driver 3 and a compression unit 5 embedded therein and the driver 3 includes a stator, a rotor, and a rotating shaft 4 inserted into a center of the rotor.

A rotating power generated from the driver 3 is transferred to the compression unit 5 to compress and discharge the refrigerant. The compression unit 5 is configured to include a fixed scroll 10 and an orbiting scroll 100, in which the fixed scroll 10 is maintained in a fixed state and the orbiting scroll 100 is eccentrically rotated with respect to the fixed scroll 10 to compress the refrigerant while relatively moving.

The orbiting scroll 100 is seated on an upper surface of a main frame 6 and is provided with a plurality of seating grooves 110 along a circumferential direction and the seating groove 110 includes a mirror plate part 101 formed in a disk shape and an orbiting wrap 102 extended to an outer side of the mirror plate part 101 and formed in a helical shape, in which a center of the mirror plate part 101 is provided with a back pressure chamber.

The plurality of seating grooves 110 are formed at a predetermined distance along a circumferential direction of the upper surface of the mirror plate part 101 and a ring member 200 is inserted into the seating groove 110, in which the ring member 200 has a diameter and a height illustrated in the drawings and is seated on an upper surface of the stepped part 120 which is formed on a lower surface of the seating groove 110.

The stepped part 120 has a shape corresponding to a lower surface of the ring member 200. According to the exemplary embodiment of the present invention, the upper surface of the stepped part 120 may be formed flatly and thus the lower surface of the ring member 200 may be formed flatly. However, the upper surface of the stepped part 120 and the lower surface of the ring member 200 may be changed to other shapes.

The orbiting scroll 100 sucks, compresses, and discharges the refrigerant while revolving with respect to the fixed scroll 10 by the rotating shaft 4. In this case, the orbiting scroll 100 repeatedly rises and falls toward the fixed scroll 10 depending on a change in pressure of the back pressure chamber. For example, when the pressure of the back pressure chamber is low, the orbiting scroll 100 rises toward the fixed scroll 10, and to the contrary, when the pressure of the back pressure chamber is high, the orbiting scroll 100 performs a relative movement while falling downward.

The so operated orbiting scroll 100 has one end fixed to the main frame 6 so as not to rotate depending on the change state in pressure of the back pressure chamber while revolving based on the rotating shaft 4 and has the other end positioned to allow a guide pin 300 extended in an inside length direction of the ring member 200 to adhere to an inside of the ring member 200.

The scroll compressor 1 generates a moving displacement in a vertical direction to allow the orbiting scroll 100 to be toward the fixed scroll 10 while the orbiting scroll 100 revolves by the rotating shaft 4. Here, the guide pin 300 is disposed in a spaced state without an end extended to the seating groove 110 being extended to a bottom surface, and as a result even when the moving displacement is generated in a vertical direction to allow the orbiting scroll 100 to be toward the fixed scroll 10, a shock due to a contact does not occur.

A more detailed description of a disposition state of the guide pin and the stepped part will be described below and the ring member inserted into the seating groove will be described first.

Referring to FIGS. 2 to 4, the ring member 200 is inserted in a state in which it is maintained at a first gap d from an inner circumferential surface of the seating groove 110. The ring member 200 is relatively rotated with respect to the inner circumferential surface of the seating groove 110 while the orbiting scroll 100 revolves. Therefore, the ring member 200 does not have a press-fit form in which it completely adheres to the seating groove 110 but preferably has the gap to relatively rotate with respect to the inner circumferential surface of the seating groove 110.

For example, the first gap d is maintained between an outer circumferential surface of the ring member 200 and the inner circumferential surface of the seating groove 110 and is preferably maintained to be in a range from 20 μm to 45 μm.

The range corresponds to a gap to stably perform the relative rotation of the ring member 200 with respect to the inner circumferential surface of the seating groove 110 without the ring member 200 being coupled with the inner circumferential surface of the seating groove 110 in the press-fit state and the stable rotation of the ring member 200 may minimize a stress applied to the outer circumferential surface of the guide pin 300*a* to be described below, which may be considered as being considerably important.

For example, if the ring member 200 is inserted into the seating groove 110 while maintaining a gap of 20 μm or less, when the ring member 200 stably performs the relative rotation in the seating groove 110, a friction may be increased and thus a friction loss may occur, such that rotation efficiency may be reduced due to the unnecessary friction loss of the ring member 200 performing the relative rotation in the seating groove 110. Further, when the gap is maintained at 45 μm or more, the ring member 200 may smoothly perform the relative rotation with respect to the inner circumferential surface of the seating groove 110, but a partial slip may occur. Therefore, maintaining the distance to be in a numerical range corresponding to the foregoing first gap d may promote the stable relative rotation of the ring member 200.

The stepped part 120 according to the first exemplary embodiment of the present invention protrudes from a circumferential direction of the bottom surface toward a central direction (r direction) at a first protruding thickness T1 when viewing the seating groove 110 from the top and protrudes upward from the bottom surface of the seating groove 110 at a first protruding height H1, in which the first protruding thickness T1 is preferably extended at a thickness equal to or smaller than a thickness t1 of the ring member 200. For this reason, if the orbiting scroll 100 revolves in the state in which the lower surface of the ring member 200 contacts the upper surface of the stepped part 120, when the ring member 200 performs the relative rotation at the upper surface of the stepped part 120 to minimize the unnecessary friction force, thereby promoting the stable rotation of the ring member 200.

Therefore, when the orbiting scroll 100 revolves based on the rotating shaft 4, the ring member 200 inserted into the seating groove 110 may stably perform the relative rotation.

The lower surface of the ring member 200 has a shape corresponding to the lower surface of the stepped part 120 while adhering to the upper surface of the stepped part 120. For example, when the lower surface of the ring member 200 is formed flatly, the upper surface of the stepped part 120 may also be formed flatly to correspond to the lower surface of the ring member 200. Further, although not illustrated in the present exemplary embodiment, the lower surface of the ring member 200 may also be formed in a convex form to minimize the friction force due to the relative rotation between the stepped part 120 and the ring member 200.

The ring member 200 is extended in a longitudinal length L1 extended from the upper surface of the stepped part 120 to the bottom surface of the seating groove 110. Further, a moving distance in the vertical direction of the ring member 200 is maintained at a distance relatively larger than the first gap d. For example, the moving displacement of the ring member 200 moving in the vertical direction of the seating groove 110 along with the operation of the scroll compressor 1 may range from a minimum of 0.3 mm to a maximum of 0.6 mm.

The moving range of the ring member 200 corresponds to the moving displacement in the vertical direction depending on the change state in pressure in the back pressure chamber, and as a result, the ring member 200 moves in the foregoing moving displacement in the vertical direction of the seating groove 110.

In particular, according to the present exemplary embodiment, the moving displacement in the vertical direction of the ring member 200 is maintained to be larger than the foregoing first gap d. The moving displacement in the vertical direction of the ring member 200 is maintained at a distance larger than the first gap d to minimize the moving displacement in the vertical direction of the orbiting scroll 100 and a stress concentration phenomenon on the guide pin 300 to be described below depending on the change state in pressure of the back pressure chamber while the relative rotation to the ring member 200 depending on the revolution is stably performed.

The guide pin 300 is maintained in the adhering state to one side of the ring member 200 inserted into the seating groove 110 and when the ring member 200 performs the relative rotation in the seating groove 110, the ring member 200 maintains the contact with the outer circumferential surface of the guide pin 300 while moving in the vertical direction. The guide pin 300 is extended along the length direction of the ring member 200 in the state in which one end of the guide pin 300 is fixed to the main frame 6 and has the other end maintained to be spaced apart from the upper surface of the stepped part 120.

The reason of allowing the guide pin 300 to be spaced apart from the upper surface of the seating groove 110 is to prevent noise from occurring due to the collision of the bottom surface of the seating groove 110 with the other end of the guide pin 300 or the guide pin 300 from being deformed and damaged, when the orbiting scroll 100 moves vertically toward the fixed scroll while revolving.

The other end of the guide pin 300 is installed to be spaced apart from the bottom surface of the seating groove 110 depending on the revolution of the orbiting scroll 100 and therefore even when the orbiting scroll 100 moves down or up toward the fixed scroll 10, the phenomenon that the other end of the guide pin 300 directly contacts the bottom surface does not occur.

The guide pin 300 maintains the contact in the length direction of the outer circumferential surface of the ring member 200. When the guide pin 300 is extended from the main frame 6 toward the inside of the ring member 200, based on the drawings, the stress is concentrated on the upper side of the ring member 200 in a first section b of the guide pin 300, in which the first section b corresponds to the moving displacement of the ring member 200 moving in the vertical direction of the orbiting scroll 100 and the first section b is not necessarily limited to the length illustrated in the drawings.

As such, when the section in which the guide pin 300 maintains a contact with the ring member 200 is not limited to a specific position but is maintained at the first section b, the guide pin 300 is not concentrated with the stress due to the contact with the ring member 200 only at the specific position of the first section b but is dispersed, and therefore even when the guide pin 300 is used for a long period of time, the guide pin 300 may be prevented from being damaged and deformed due to the stress concentration to promote the stable operation of the orbiting scroll 100.

Figure 5:
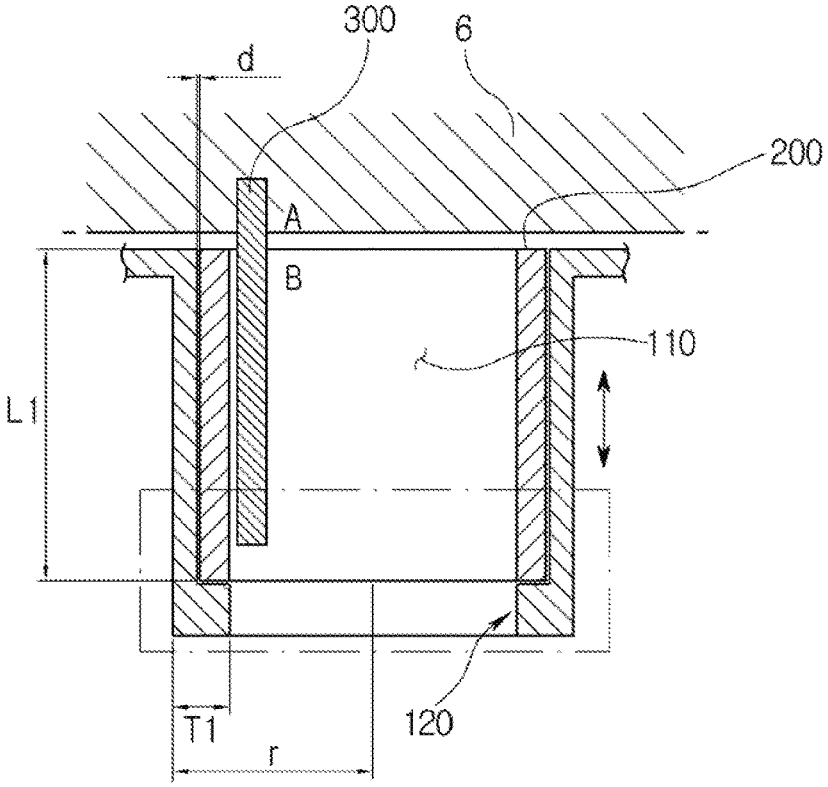
FIG. 5 is a diagram illustrating a section in which a stress is applied to a guide pin depending on a moving displacement of a ring member according to a first exemplary embodiment of the present invention.

Referring to FIG. 5, for example, when the orbiting scroll 100 relatively moves toward the fixed scroll 10, the stress may be concentrated on position A or position B of the guide pin 300 but the concentrated stress is not repeatedly applied to the positions A and B but is applied to another position of the first section b in the dispersed state, such that the guide pin 300 may be stably used.

The guide pin 300 may allow the orbiting scroll 100 to relatively move toward the fixed scroll 10 and fall when the pressure of the back pressure chamber is high, and to the contrary, rise when the pressure of the back pressure chamber is low, and therefore the lower end of the guide pin 300 need not contact the bottom surface of the seating groove 110. As a result, for this purpose, the present invention maintains the state in which the bottom surface of the seating groove 110 and the lower end of the guide pin 300 are spaced apart from each other.

Further, the foregoing stepped part 120 is disposed at the lower end of the guide pin 300 but is not disposed at a position where it directly interferes with the guide pin 300, such that the phenomenon that the lower end of the guide pin 300 is damaged or deformed does not occur independent of the operation of the orbiting scroll 100.

A scroll compressor according to a second exemplary embodiment of the present invention will be described with reference to the accompanying drawings. Differently from the foregoing exemplary embodiment, the present exemplary embodiment has the feature that the area in which the lower surface of the ring member seated on the stepped part maintains the contact with the upper surface of the stepped part differently.

Figure 6:
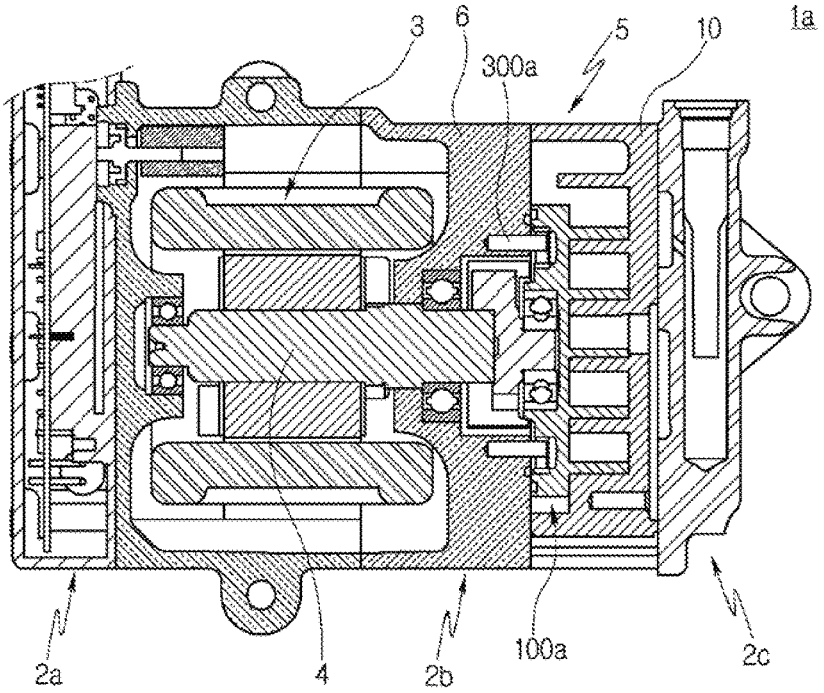
FIG. 6 is a longitudinal cross-sectional view of a scroll compressor according to a second exemplary embodiment of the present invention.
Figure 7:
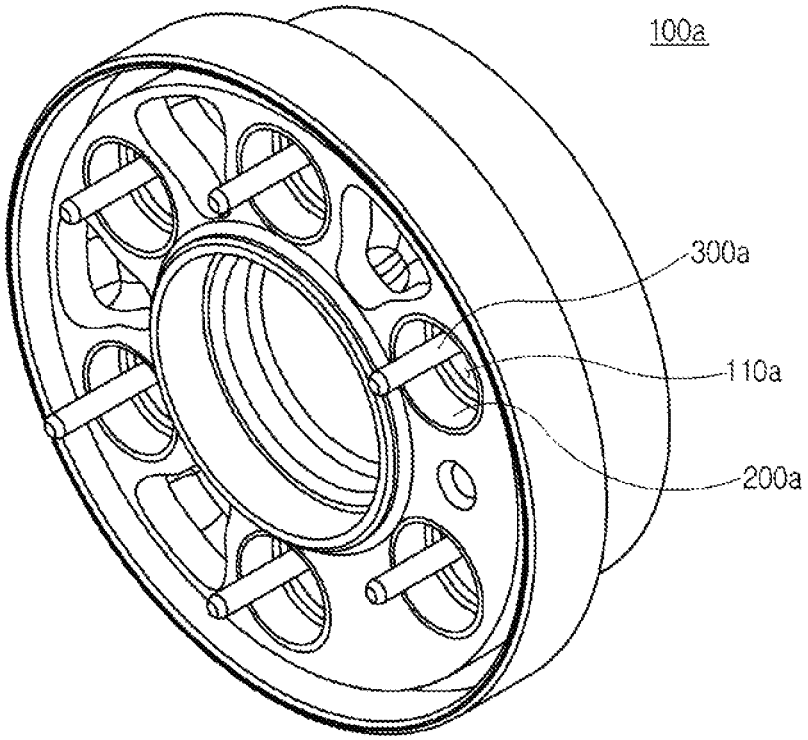
FIG. 7 is a coupled perspective view of the scroll compressor according to the second exemplary embodiment of the present invention.
Figure 8:
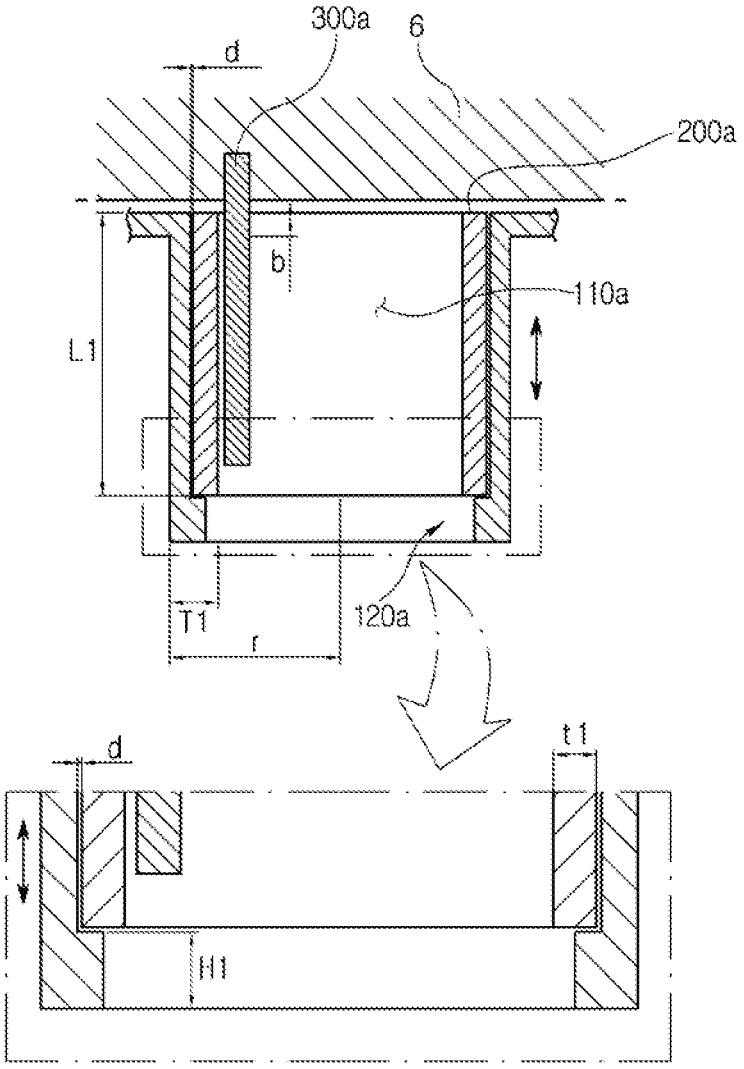
FIG. 8 is a partial cross-sectional view of the scroll compressor according to the second exemplary embodiment of the present invention.

Referring to FIGS. 6 to 8, a scroll compressor 1*a* according to the present exemplary embodiment is configured to include an orbiting scroll 100*a* seated on the upper surface of the main frame 6 and provided with a plurality of seating grooves 110*a* along a circumferential direction, a stepped part 120*a* formed in the seating groove 110*a*, a ring member 200*a* inserted into the seating groove 110*a* and maintained in a state in which a lower surface of the ring member 200*a* partially contacts an upper surface of the stepped part 120*a*, and a guide pin 300*a* having one end fixed to the main frame 6 and the other end extended in an inside length direction of the ring member 200*a*.

According to the present exemplary embodiment, the feature that the ring member 200*a* maintains the contact with the upper surface of the stepped part 120*a* is the same as that of the foregoing first exemplary embodiment, but the state in which the upper surface of the stepped part 120*a* and the lower surface of the ring member 200*a* completely contact each other is not maintained but as illustrated in the drawings, the state in which the upper surface of the stepped part 120*a* and the lower surface of the ring member 200*a* contact each other by half is maintained, such that the state in which the friction force occurring when the ring member 200*a* is rotated in the seating groove 110*a* may be maintained in the relatively reduced state.

For example, the upper surface of the stepped part 120*a* is extended to a central position of the lower surface of the ring member 200*a*. The lower end of the guide pin 300*a* to be described below is spaced apart from the bottom surface of the seating groove 110*a* to prevent the direct collision with the bottom surface of the seating groove 110*a*, such that even when the orbiting scroll 100*a* relatively moves toward the fixed scroll 10, the lower end of the guide pin 300*a* does not directly contact the stepped part 120*a*. Further, the upper surface of the stepped part 120*a* does not extend to the contactable position with the guide pin 300*a* by way of the lower surface of the ring member 200*a* and therefore even when the orbiting scroll 100*a* relatively moves, the phenomenon that the lower end of the guide pin 300*a* directly interferes with the stepped part 120*a* does not occur.

The orbiting scroll 100*a* sucks, compresses, and discharges the refrigerant while revolving with respect to the fixed scroll 10 by the rotating shaft 4. In this case, the orbiting scroll 100*a* repeatedly rises and falls toward the fixed scroll 10 depending on the state change of the refrigerant.

For example, when the pressure of the back pressure chamber is low, the orbiting scroll 100*a* rises toward the fixed scroll 10, and to the contrary, when the pressure of the back pressure chamber is high, the orbiting scroll 100*a* performs the relative movement depending on the pressure state of the refrigerant while falling downward.

The so operated orbiting scroll 100*a* has one end fixed to the main frame 6 so as not to rotate depending on the change state in pressure of the back pressure chamber while revolving based on the rotating shaft 4 and has the other end positioned to allow the guide pin 300*a* extended in an inside length direction of the ring member 200*a* to adhere to an inside of the ring member 200*a*.

The so operated scroll compressor 1*a* generates a moving displacement in a vertical direction to allow the orbiting scroll 100*a* to be toward the fixed scroll 10 while the orbiting scroll 100*a* revolving by the rotating shaft 4. Here, the guide pin 300*a* is disposed in a spaced state without an end extended to the seating groove 110*a* being extended to a bottom surface, and as a result even when the moving displacement is generated in a vertical direction to allow the orbiting scroll 100*a* to be toward the fixed scroll 10, the shock due to the contact does not occur.

Referring to FIG. 8, the ring member 200*a* is inserted into the seating groove 110*a* in the state in which it is maintained at the first gap d from the inner circumferential surface of the seating groove 110*a*. The ring member 200*a* is relatively rotated with respect to the inner circumferential surface of the seating groove 110*a* while the orbiting scroll 100*a* revolves. Therefore, the ring member 200*a* does not have a press-fit form in which it completely adheres to seating groove 110*a* but preferably has the gap to relatively rotate with respect to the inner circumferential surface of the seating groove 110*a*.

For example, the first gap d is maintained between the outer circumferential surface of the ring member 200*a* and the inner circumferential surface of the seating groove 110*a* and is preferably maintained to be in a range from 20 μm to 45 μm.

The range corresponds to the gap to stably perform the relative rotation of the ring member 200*a* with respect to the inner circumferential surface of the seating groove 110*a* without the ring member 200*a* being coupled with the inner circumferential surface of the seating groove 110*a* in the press-fit state and the stable rotation of the ring member 200*a* may minimize a stress applied to the outer circumferential surface of the guide pin 300*a* to be described below, which may be considered as being considerably important.

The stepped part 120*a* protrudes from a circumferential direction of the bottom surface toward a central direction (r direction) at a first protruding thickness T1 when viewing the seating groove 110*a* from the top and protrudes upward from the bottom surface of the seating groove 110*a* at a first protruding height H1, in which the first protruding thickness T1 is preferably extended at a thickness equal to or smaller than a thickness t1 of the ring member.

For this reason, if the orbiting scroll 100*a* revolves in the state in which the lower surface of the ring member 200*a* contacts the upper surface of the stepped part 120*a*, when the ring member 200*a* performs the relative rotation at the upper surface of the stepped part 120*a* to minimize the unnecessary friction force, thereby promoting the stable rotation of the ring member 200*a*. Therefore, when the orbiting scroll 100*a* revolves based on the rotating shaft 4, the ring member 200*a* inserted into the seating groove 110*a* may stably perform the relative rotation.

The lower surface of the ring member 200*a* has a shape corresponding to the lower surface of the stepped part 120*a* while adhering to the upper surface of the stepped part 120*a*. For example, when the lower surface of the ring member 200*a* is formed flatly, the upper surface of the stepped part 120*a* may also be formed flatly to correspond to the lower surface of the ring member 200*a*. Further, although not illustrated in the present exemplary embodiment, the lower surface of the ring member 200*a* may also be formed in a convex form to minimize the friction force due to the relative rotation between the stepped part 120*a* and the ring member 200*a*.

The ring member 200*a* is extended in the longitudinal length L1 extended from the upper surface of the stepped part to the upper surface of the seating groove and the moving direction in the vertical direction of the ring member 200*a* is maintained as a distance relatively larger than the first gap. For example, the moving displacement of the ring member 200*a* moved in the vertical direction of the seating groove 110*a* along with the operation of the scroll compressor 1 ranges from a minimum of 0.32 mm to a maximum of 0.53 mm.

The moving range of the ring member 200*a* corresponds to the moving displacement in the vertical direction depending on the change state in pressure in the back pressure chamber and the moving displacement corresponds to an operation radius generated while the orbiting scroll 100*a* revolves, and as a result, the ring member 200*a* moves in the foregoing moving displacement in the vertical direction of the seating groove 110*a*.

In particular, according to the present exemplary embodiment, the moving displacement in the vertical direction of the ring member 200*a* is maintained to be larger than the foregoing first gap d. The moving displacement in the vertical direction of the ring member 200*a* is maintained at a distance larger than the first gap d to minimize the moving displacement in the vertical direction of the orbiting scroll 100*a* and a stress concentration phenomenon on the guide pin 300*a* to be described below depending on the change state in pressure of the back pressure chamber while the relative rotation to the ring member 200*a* depending on the revolution is stably performed.

The guide pin 300*a* is maintained to adhere to one side of the ring member 200*a* inserted into the seating groove 110*a* and when the ring member 200*a* performs the relative rotation in the seating groove 110*a*, the ring member 200*a* maintains the contact with the outer circumferential surface of the guide pin 300*a* while moving in the vertical direction. The guide pin 300*a* is extended along the length direction of the ring member 200*a* in the state in which one end of the guide pin 300*a* is fixed to the main frame 6 and has the other end maintained to be spaced apart from the upper surface of the stepped part 120*a*.

The reason of allowing the guide pin 300*a* to be spaced apart from the upper surface of the seating groove 110*a* is to prevent noise from occurring due to the direct collision of the bottom surface of the seating groove 110*a* with the other end of the guide pin 300*a* or the guide pin 300*a* from being deformed and damaged, when the orbiting scroll 100*a* moves vertically toward the fixed scroll 10 while revolving.

The other end of the guide pin 300*a* is installed to be spaced apart from the bottom surface of the seating groove 110*a* depending on the revolution of the orbiting scroll 100*a* and therefore even when the orbiting scroll 100*a* moves down or up toward the fixed scroll 10, the other end of the guide pin 300*a* directly contacts the bottom surface and thus the shock does not occur.

A scroll compressor according to a third exemplary embodiment of the present invention will be described with reference to the accompanying drawings. Differently from the foregoing exemplary embodiment, the present exemplary embodiment has a difference in the fact that the lower surface of the ring member seated on the stepped part does not contact the upper surface of the stepped part in the whole section and the lower surface of the ring member maintains the contact with the upper surface of the stepped part in a partially subdivided state.

Figure 9:
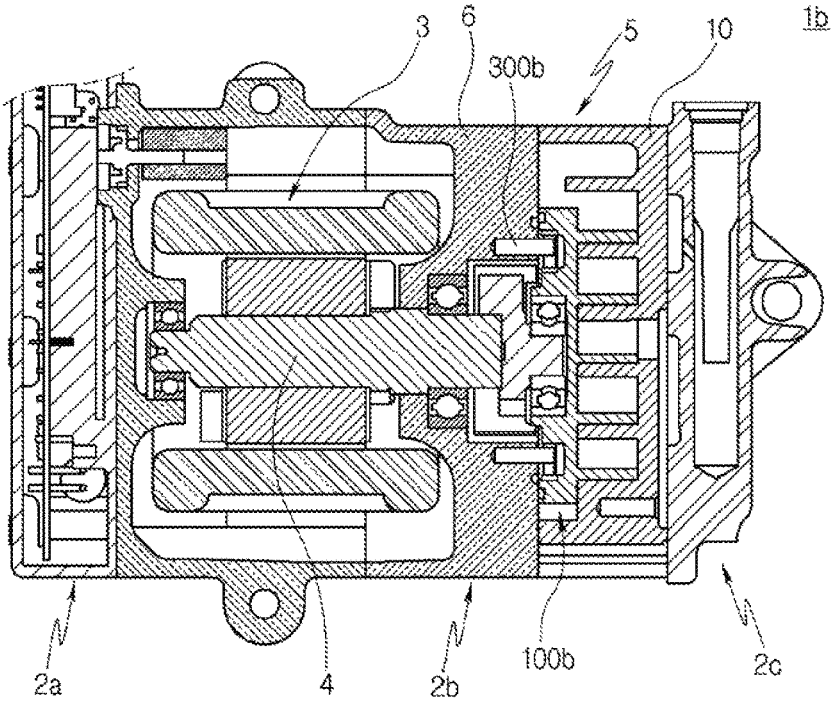
FIG. 9 is a longitudinal cross-sectional view of a scroll compressor according to a third exemplary embodiment of the present invention.
Figure 10:
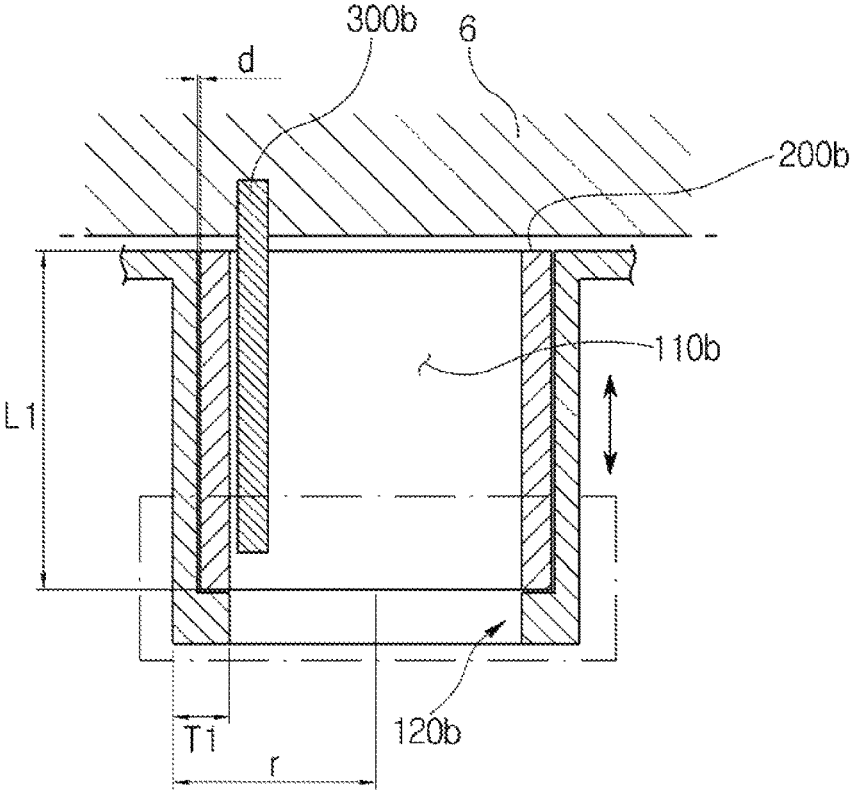
FIG. 10 is a cross-sectional view illustrating a state in which a ring member is seated in a stepped part according to a third exemplary embodiment of the present invention.
Figure 11:
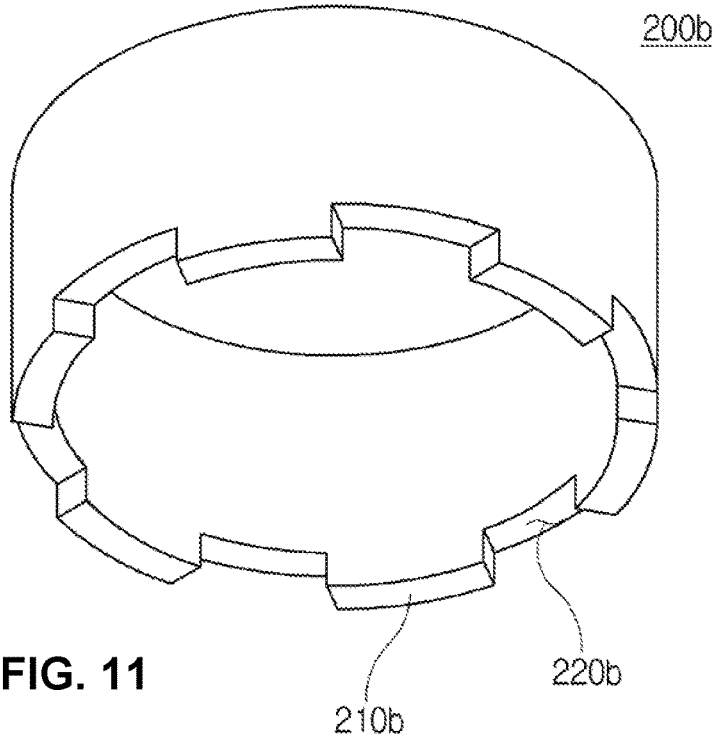
FIG. 11 is a perspective view illustrating the ring member according to the third exemplary embodiment of the present invention.

Referring to FIGS. 9 to 11, a scroll compressor 1*b* according to the present exemplary embodiment is configured to include an orbiting scroll 100*b* seated on the upper surface of the main frame 6 and provided with a plurality of seating grooves 110*b* along a circumferential direction, a stepped part 120*b* formed in the seating groove 110*b*, a ring member 200*b* inserted into the seating groove 110*b* and maintained in a state in which a lower surface of the ring member 200*b* partially contacts the stepped part 120*b*, and a guide pin 300*b* having one end fixed to the main frame 6 and the other end extended in an inside length direction of the ring member 200*b*. For reference, a structure of the stepped part 120*b* is similar to that of the first exemplary embodiment and therefore a detailed description thereof will be omitted.

For example, the ring member 200*b* is configured to include protruding parts 210*b* protruding to maintain the contact with the stepped part 120*b* in the circumferential direction and groove parts 220*b* formed toward the inside of the ring member 200 while being adjacent to the protruding parts 210*b*, in which the protruding parts 210*b* and the groove parts 220*b* are disposed in the state in which they are alternately repeated along the circumferential direction of the ring member 200*b*. That is, if the protruding parts 210*b* protrude toward of the lower side of the ring member 200*b*, the adjacent groove parts 200*b* have a form depressed inwardly or as illustrated in the drawings, a rectangular cross section form. Here, the protruding parts 210*b* and the groove parts 220*b* are repeatedly disposed in such a form.

The protruding part 210*b* is maintained in the contacted state with the upper surface of the stepped part 120*b* but does not maintain the surface contacted state with the whole area of the upper surface of the stepped part 120*b*, and therefore even when the ring member 200*b* is relatively rotated at the upper surface of the stepped part 120*b*, the friction force may be minimized, thereby promoting the stable relative rotation of the ring member 200*b*.

The circumferential direction length of the protruding part 210*b* and the circumferential direction length of the groove part 220*b* may be extended similarly or the groove part 220*b* may be extended relatively longer than the protruding part 210*b* and therefore is not necessarily limited to the length illustrated in the drawings.

Figure 12:
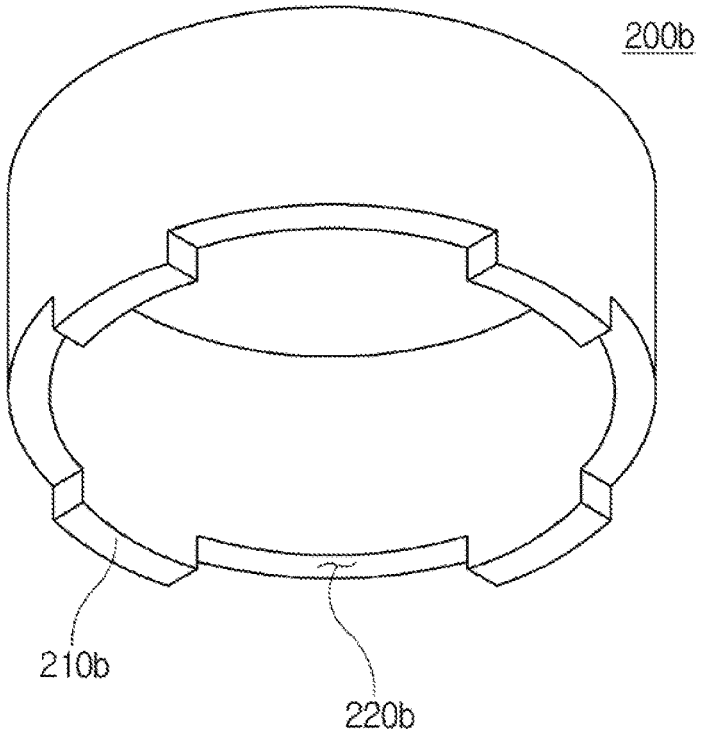
FIGS. 12 and 13 are diagrams schematically illustrating various forms of the ring member according to the third exemplary embodiment of the present invention.

Referring to FIG. 12, the protruding parts 210*b* are disposed in the opposite state to each other at the lower surface of the ring member 200*b*. In the case of the protruding part 210*b* seated on the upper surface of the stepped part 120*b*, the friction force generated when the relative rotation with respect to the outer circumferential surface of the seated groove 110*b* is performed may be largely divided into a wall surface friction generated at a wall surface and a protruding part friction force generated at the protruding part 210*b* and the upper surface of the stepped part 120*b* and the friction force depending on the rotation of the ring member 200*b* depending on the revolution of the orbiting scroll 100*b* is minimized and thus the ring member 200*b* may be easily rotated. In particular, when the rotation of the ring member 200*b* is maintained in the seating groove 110*b* due to the friction force generated between the inner circumferential surface of the ring member 200*b* and the outer circumferential surface of the guide pin 300*b*, the stress concentration may be increased due to the friction with the guide pin 300*b*, and therefore the smooth rotation of the ring member 200*b* and the reduction in the friction force have a very important relationship.

Therefore, minimizing the friction force along with the stable rotation of the ring member 200*b* may promote the stable revolution of the orbiting scroll 100*b*.

The protruding part 210*b* preferably protrudes by the length corresponding to the thickness of the ring member 200*b*. When the protruding length is extended to be longer than the length illustrated in the drawings, the weight of the ring member 200*b* is reduced and thus the weight reduction may be implemented but the protruding part 210*b* is extended by the length illustrated in the drawings in consideration of the damage and the deformation of the protruding part 210*b* but protrudes by the length corresponding to the thickness, such that the structural strength is stably maintained and the friction force depending on the rotation of the ring member 200*b* is minimally maintained, thereby minimizing the generation of the unnecessary friction force depending on the rotation.

Figure 13:
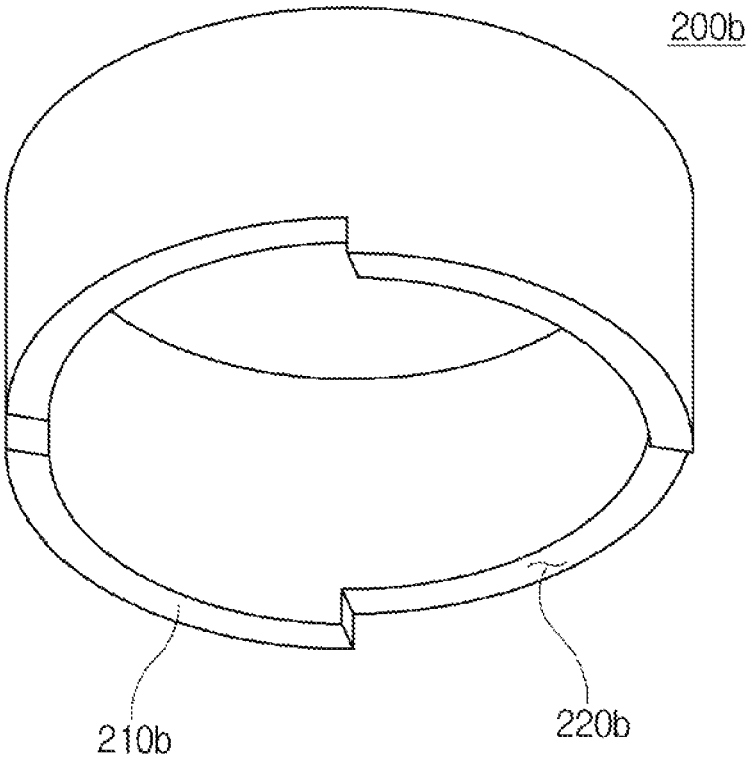

Referring to FIG. 13, the ring member 200*b* according to another exemplary embodiment of the present invention is extended in the state in which the protruding parts 210*b* face each other as illustrated in the drawings. Here, the protruding length of the protruding part 210*b* is extended similarly to the thickness of the ring member 200*b*, the protruding parts 201*b* are disposed in the opposite to each other, and the protruding part 210*b* and the groove part 220*b* are repeatedly disposed.

According to the present exemplary embodiment, the protruding parts 210*b* are maintained in the contacted state by a predetermined section on the upper surface of the stepped part 120. If the whole area of the upper surface of the stepped part 120 is assumed to be 100%, the protruding part 210*b* is surface contacted in the range that the contacted area of the protruding part 210*b* is about 50%, and as a result, the friction depending on the rotation of the ring member 200*b* may be minimized and the orbiting scroll 100 may be stably rotated.

INDUSTRIAL APPLICATION

According to the scroll compressor in accordance with the exemplary embodiments of the present invention, the end of the guide pin may be maintained in the spaced state from the seating groove of the orbiting scroll, thereby promoting the stable revolution operation of the orbiting scroll.

What is claimed is:

1. A scroll compressor comprising:

an orbiting scroll configured to be seated on a surface of a main frame, the orbiting scroll including a plurality of seating grooves formed therein, each of the seating grooves including a stepped part;

a ring member inserted into one of the seating grooves, the ring member including a lower surface in contact with the stepped part of the one of the seating grooves, wherein an upper surface of the stepped part of the one of the seating grooves is in contact with only a first portion of the lower surface of the ring member, and wherein a second portion of the lower surface of the ring member is disposed radially inwardly from and does not contact the upper surface of the stepped part of the one of the seating grooves; and a guide pin having a first end fixed to the main frame and a second end extending into an interior of the ring member, wherein the second end of the guide pin is spaced apart from the stepped part of the one of the seating grooves.

2. The scroll compressor of claim 1, wherein the ring member is spaced apart from an inner circumferential surface of the one of the seating grooves by a first gap d.

3. The scroll compressor of claim 2, wherein a width of the first gap d ranges from 20 μm to 45 μm, and wherein a moving distance of the ring member in a direction parallel to a central axis of the ring member within the one of the seating grooves is maintained at a distance greater than a width of the first gap d.

4. The scroll compressor of claim 1, wherein the stepped part of the one of the seating grooves has a shape corresponding to a shape of the lower surface of the ring member.

5. The scroll compressor of claim 1, further comprising a fixed scroll disposed adjacent the orbiting scroll, wherein the ring member moves in a direction parallel to a central axis of the ring member within the one of the seating grooves on a basis of a change of pressure according to a compression and a discharge of a refrigerant depending on an orbiting of the orbiting scroll relative to the fixed scroll.

6. The scroll compressor of claim 5, wherein the ring member is spaced apart from an inner circumferential surface of the one of the seating grooves by a first gap d and a moving distance of the ring member in the direction parallel to the central axis of the ring member is maintained at a distance greater than a width of the first gap d.

7. The scroll compressor of claim 5, wherein the guide pin includes a first section b maintaining contact with the ring member, wherein a stress applied to the first section b is dispersed along the first section b based on a displacement of the ring member in the direction parallel to the central axis of the ring member.

8. The scroll compressor of claim 1, further comprising a fixed scroll, the orbiting scroll configured to orbit relative to the fixed scroll, wherein the guide pin maintains contact with and travels along an inner circumferential surface of the ring member during an orbiting of the orbiting scroll relative to the fixed scroll.

9. The scroll compressor of claim 1, wherein the ring member has a longitudinal length L1 extending from an upper surface of the stepped part to an upper surface of the one of the seating grooves.

10. The scroll compressor of claim 1, wherein the stepped part protrudes radially inwardly at a first protruding thickness T1 from a circumferential direction of a bottom surface of the seating groove and protrudes at a first protruding height H1 upward from the bottom surface of the seating groove.

11. The scroll compressor of claim 10, wherein the first protruding thickness T1 is equal to or smaller than a thickness t1 of the ring member.

12. A scroll compressor comprising:

an orbiting scroll configured to be seated on a surface of a main frame, the orbiting scroll including a seating groove formed therein, the seating groove including a stepped part;

a ring member inserted into the seating groove, the ring member including a lower surface in partial contact with the stepped part of the seating groove, wherein the lower surface of the ring member includes a plurality of protruding parts protruding to contact the stepped part of the seating groove, wherein the lower surface of the ring member further includes a plurality of groove parts, and wherein the protruding parts and the groove parts are alternately repeated along a circumferential direction of the lower surface of the ring member; and a guide pin having a first end fixed to the main frame and a second end extending into an interior of the ring member.

13. The scroll compressor of claim 12, wherein each of the plurality of protruding parts is diametrically opposed to another one of the plurality of protruding parts.

14. The scroll compressor of claim 12, wherein each of the plurality of protruding parts protrudes from the lower surface of the ring member by a length equal to a thickness of the ring member.

15. The scroll compressor of claim 12, wherein the second end of the guide pin is spaced apart from an upper surface of the stepped part of the seating groove.

* * * * *